US010230172B1

(12) United States Patent
Wolf et al.

(10) Patent No.: US 10,230,172 B1
(45) Date of Patent: Mar. 12, 2019

(54) THIN METAL ULTRA-WIDEBAND ANTENNA ARRAY SYSTEMS AND METHODS

(71) Applicant: Rockwell Collins, Inc., Cedar Rapids, IA (US)

(72) Inventors: Jeremiah D. Wolf, Atkins, IA (US); Matilda G. Livadaru, Marion, IA (US); Nathan P. Lower, North Liberty, IA (US); David W. Cripe, Mount Vernon, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 0 days.

(21) Appl. No.: 15/048,969

(22) Filed: Feb. 19, 2016

(51) Int. Cl.

| | |
|---|---|
| ***H01Q 1/52*** | (2006.01) |
| ***H01Q 5/25*** | (2015.01) |
| ***H01Q 21/00*** | (2006.01) |
| ***H01Q 21/06*** | (2006.01) |

(52) U.S. Cl.
CPC ..... *H01Q 21/064* (2013.01); *H01Q 1/526* (2013.01); *H01Q 5/25* (2015.01); *H01Q 21/0075* (2013.01)

(58) Field of Classification Search
CPC ..... H01Q 21/0075; H01Q 21/0093; H01Q 21/064; H01Q 1/526; H01Q 5/25
See application file for complete search history.

(56) References Cited

U.S. PATENT DOCUMENTS

| | | | | |
|---|---|---|---|---|
| 4,862,186 | A * | 8/1989 | Strider | H01Q 21/064 333/137 |
| 5,461,392 | A * | 10/1995 | Mott | H01Q 13/085 343/705 |
| 6,891,511 | B1 * | 5/2005 | Angelucci | H01Q 21/064 343/767 |
| 7,391,382 | B1 * | 6/2008 | Mason | G01S 7/032 343/754 |
| 2007/0126648 | A1 * | 6/2007 | Svensson | H01Q 13/085 343/767 |
| 2008/0211726 | A1 * | 9/2008 | Elsallal | H01Q 21/064 343/770 |
| 2013/0082890 | A1 * | 4/2013 | Wang | H01Q 1/286 343/770 |

(Continued)

*Primary Examiner* — Daniel Munoz
(74) *Attorney, Agent, or Firm* — Donna P. Suchy; Daniel M. Barbieri

(57) ABSTRACT

An antenna array system can include a plurality of sheet metal structures arranged substantially parallel to one another. Each sheet metal structure can include a row of antenna elements and the plurality of sheet metal structures can form an array of antenna elements. The antenna array system can include a plurality of printed circuit boards (PCBs) each of which is mechanically and electrically coupled to a respective sheet metal structure. Each sheet metal structure extends beyond the PCB to which it is mechanically coupled. The antenna array system can include at least one electromagnetic shielding structure configured to electromagnetically shield one or more circuit components from the array of antenna elements. The antenna array system can also include one or more alignment structures configured to provide mechanical rigidity to the array of antenna elements and to allow for spacing between pairs of adjacent sheet metal structures.

19 Claims, 8 Drawing Sheets

(56) References Cited

U.S. PATENT DOCUMENTS

| | | | | |
|---|---|---|---|---|
| 2014/0218251 | A1* | 8/2014 | Waschenko | H01Q 13/10 343/770 |
| 2015/0372394 | A1* | 12/2015 | Crockett, Jr. | H01Q 21/061 343/700 MS |

* cited by examiner

THIN METAL ULTRA-WIDEBAND ANTENNA ARRAY SYSTEMS AND METHODS

FIELD OF THE DISCLOSURE

The present disclosure relates generally to the field of antenna arrays including but not limited to, phased array antenna systems or electronically scanned array (ESA) antenna systems, such as active electronically scanned array (AESA) antenna systems.

BACKGROUND

Antenna arrays can provide improved antenna performance by allowing control of phase (or relative time delay) and relative amplitude of the signal associated with each antenna element in an antenna array. By adjusting signal phase and/or relative amplitude of separate antenna elements, information redundancy in signals associated with distinct antenna elements can be used to form a desired beam signal.

SUMMARY

In one aspect, embodiments of the inventive concepts disclosed herein are directed to an antenna array system that includes a plurality of sheet metal structures arranged substantially parallel to one another. Each sheet metal structure can comprise a row of antenna elements. When arranged substantially parallel to one another, the plurality of sheet metal structures can form an array of antenna elements. The antenna array system can include a plurality of printed circuit boards (PCBs) each of which is mechanically and electrically coupled to a respective sheet metal structure, such that each respective sheet metal structure extends beyond the PCB to which it is mechanically coupled. The antenna array system can include at least one electromagnetic shielding structure configured to electromagnetically shield one or more circuit components electrically coupled to the array of antenna elements, from the array of antenna elements. The antenna array system can include one or more alignment structures configured to provide mechanical rigidity to the array of antenna elements and to allow for spacing between pairs of adjacent sheet metal structures.

In some embodiments, the antenna elements in each sheet metal structure can be physically formed using laser cutting or chemical etching. In some embodiments, the one or more alignment structures can include the at least one electromagnetic shielding structure. In some embodiments, the at least one electromagnetic shielding structure can be spatially arranged to be substantially perpendicular to a planar structure of at least one of the plurality of sheet metal structures. The at least one electromagnetic shielding structure can include a plurality of electromagnetic interference (EMI) gasket ground planes. Each of the plurality of EMI gasket ground planes can be physically coupled to a respective one of the plurality of sheet metal structures.

In some embodiments, each PCB can include one or more amplifiers and one or more phase-shifters configured to control amplitudes and phases, respectively, of signals associated with antenna elements of a corresponding sheet metal structure coupled to the PCB. In some embodiments, the array of antenna elements can have a frequency bandwidth that includes at least the frequency range between 18 GHz and 60 GHz.

In some embodiments, the one or more alignment structures can comprise one or more alignment rods. The antenna array system can further include a plurality of spacers arranged along each of the one or more alignment rods. Each spacer can be configured to separate a respective pair of adjacent sheet metal structures by a predefined distance. In some embodiments, the one or more alignment structures can include a plurality of mechanical housing structures that are configured to be mechanically coupled to each other. Each mechanical housing structure can be configured to receive a respective sheet metal structure of the plurality of sheet metal structures or a respective PCB of the plurality of PCBs. The plurality of sheet metal structures can be arranged parallel to each other when the plurality of mechanical housing structures are mechanically coupled to each other.

In another aspect, embodiments of the inventive concepts disclosed herein are directed to a method of manufacturing an antenna array system. The method can include mechanically and electrically coupling each of a plurality of sheet metal structures to a respective printed circuit board (PCB). Each of the plurality of sheet metal structures can comprise a row of antenna elements extending beyond the PCB to which the sheet metal structure is mechanically coupled. The method can also include arranging the plurality of sheet metal structures substantially parallel to one another by using one or more alignment structures. The plurality of sheet metal structures can form an array of antenna elements. The method can also include incorporating at least one electromagnetic shielding structure to the array of antenna elements to electromagnetically shield the array of antenna elements from one or more circuit components electrically coupled to the array of antenna elements.

In some embodiments, the antenna elements in each sheet metal structure are physically formed using laser cutting or chemical etching. In some embodiments, the one or more alignment structures can include the at least one electromagnetic shielding structure. In some embodiments, incorporating at least one electromagnetic shielding structure can include spatially arranging the at least one electromagnetic shielding structure to be substantially perpendicular to a planar structure of at least one of the plurality of sheet metal structures. In some embodiments, arranging the at least one electromagnetic shielding structure can include arranging a plurality of electromagnetic interference (EMI) gasket ground planes. In some embodiments, each of the plurality of EMI gasket ground planes are physically coupled to a respective one of the plurality of sheet metal structures.

In some embodiments, each PCB can include one or more amplifiers and one or more phase-shifters configured to control amplitudes and phases, respectively, of signals associated with antenna elements of a corresponding sheet metal structure coupled to the PCB. In some embodiments, the array of antenna elements can have a frequency bandwidth that includes at least the frequency range extending between 18 GHz and 60 GHz.

In some embodiments, the one or more alignment structures can comprise one or more alignment rods. In some embodiments, a plurality of spacers is arranged along each of the one or more alignment rods. Each spacer can be configured to separate a respective pair of adjacent sheet metal structures by a predefined distance.

BRIEF DESCRIPTION OF THE DRAWINGS

Embodiments of the inventive concepts disclosed herein will become more fully understood from the following detailed description, taken in conjunction with the accompanying drawings, wherein like reference numerals refer to like elements, in which.

Figure 1A:
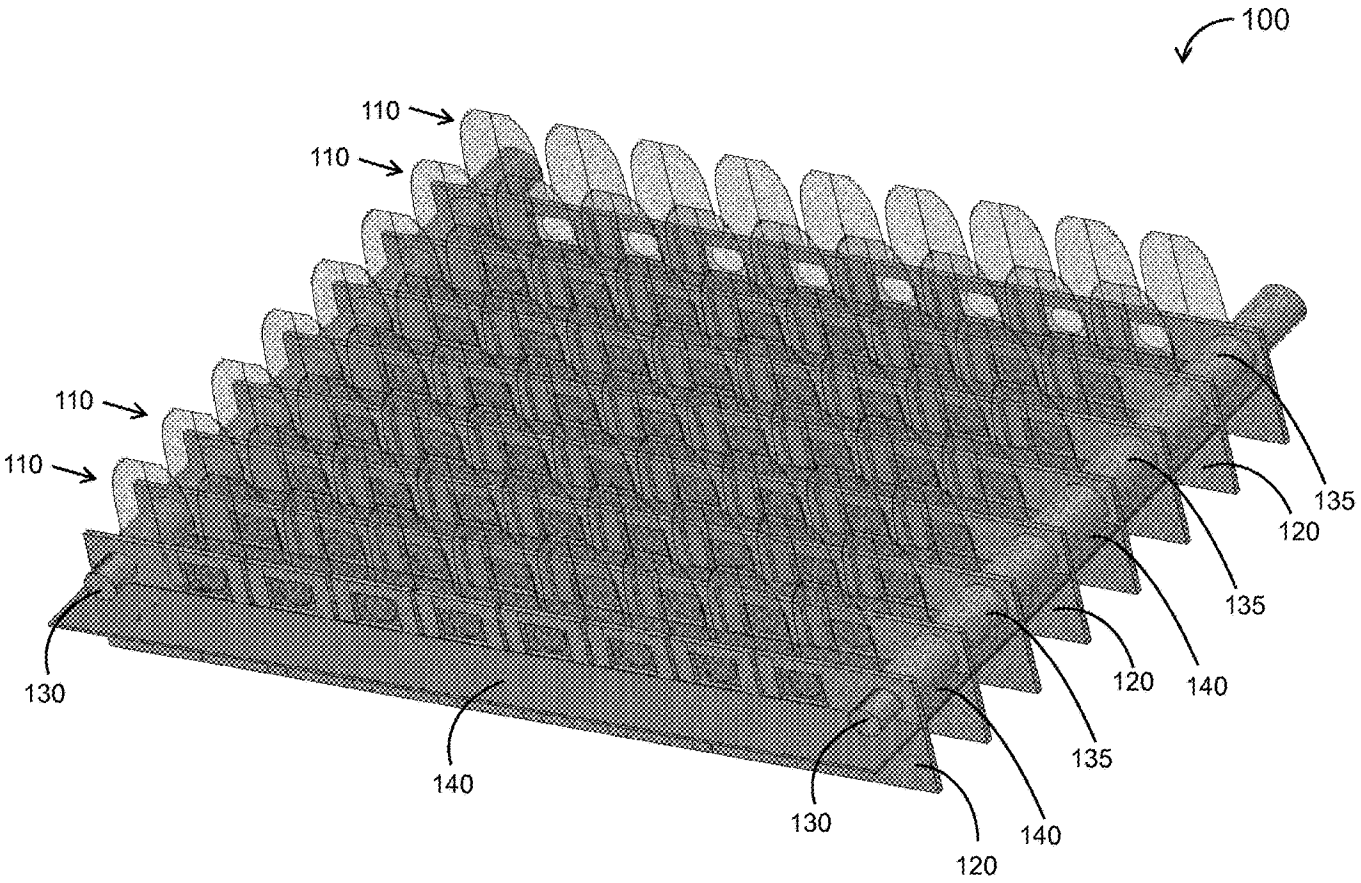
FIG. 1A is a diagram depicting a pictorial view of a first embodiment of a thin metal antenna array system.

The details of various embodiments of the methods and systems are set forth in the accompanying drawings and the description below.

DETAILED DESCRIPTION

Before describing in detail embodiments of the inventive concepts disclosed herein, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the diagrams provided in this disclosure, but should be construed in accordance with the language in the claims.

Ultra-wideband (UWB) steerable antenna arrays have gained a lot of attraction in wireless communications, remote sensing, biological or medical microwave imaging, aviation applications, military applications, and/or the like. The UWB steerable antenna arrays can include, but are not limited to, phased-array antenna systems or electronically scanned array (ESA) antenna systems, such as active electronically-scanned array (AESA) antenna systems. Most existing UWB steerable antenna array systems operate at frequency bandwidths within 2 to 18 GHz. Within such a frequency range, UWB steerable antenna array systems can be manufactured at a relatively low cost compared to other more complex antenna systems, and can provide high accuracy performance. Existing UWB steerable antenna array systems are usually constructed using printed tapered slot antennas. Printed tapered slot antennas are manufactured as dielectric plates that are metalized on both sides.

In some aspects, the present disclosure describes increasing the operating frequency range of UWB steerable antenna array systems beyond 18 GHz. For example, the operating frequency range of UWB steerable antenna array systems can be extended to include the Ka-Band, which covers frequencies between 26.5 GHz and 40 GHz. Such extension in the operating frequency range can translate to a significant reduction in the size of antenna elements, e.g., tapered slot antennas (TSAs), of UWB steerable antenna array systems. In particular, the width of the antenna elements of an UWB steerable antenna array system is defined to be smaller than the size of the shortest wavelength supported by that UWB steerable antenna array system. Within the Ka-Band, the wavelength varies between 11.1 and 7.5 millimeters (or between 437 and 295 mils). Employing printed circuit board fabrication methods may not be feasible for manufacturing antenna array systems that support a significantly extended frequency range. For example, extending the frequency range of 2 to 18 GHz to support frequencies between 18 and 60 GHz can impose a reduction in the size of feed lines of antenna elements from 5 mils to 1.5 mils. Satisfying such a reduction in the size of the feed lines as well as the reduction in the width of the antenna elements can result in a substantial increase in the manufacturing cost of UWB steerable antenna array systems when using printed circuit board or traditional fabrication methods.

In the current disclosure, it is described that UWB steerable antenna array systems can be manufactured using thin metal planar antenna elements. In particular, a UWB steerable antenna array system can include a plurality of thin metal structures (or sheet metal structures), each of which represents a one-dimensional (1-D) array of thin metal planar antenna elements. Using manufacturing processes such as laser cutting, chemical etching, or electroforming, sheet metal structures with high resolution (or dimensionally precise) planar antenna elements can be manufactured at a relatively low cost. For example, the accuracy of laser cutting is within ±5 micrometers (μm). The sheet metal structures can be arranged substantially parallel to one another to form a two-dimensional (2-D) array of thin metal planar antenna elements. Each thin metal structure can be mechanically and electrically coupled to a respective printed circuit board (PCB). The sheet metal structures can be mechanically coupled to each other using one or more alignment structures. In some embodiments, the UWB steerable antenna array system can include at least one electromagnetic shielding structure for shielding one or more active/electronic circuit components from electromagnetic radiations associated with the planar antenna elements, and/or the planar antenna elements from electromagnetic radiations associated with the one or more active/electronic circuit components.

Figure 1B:
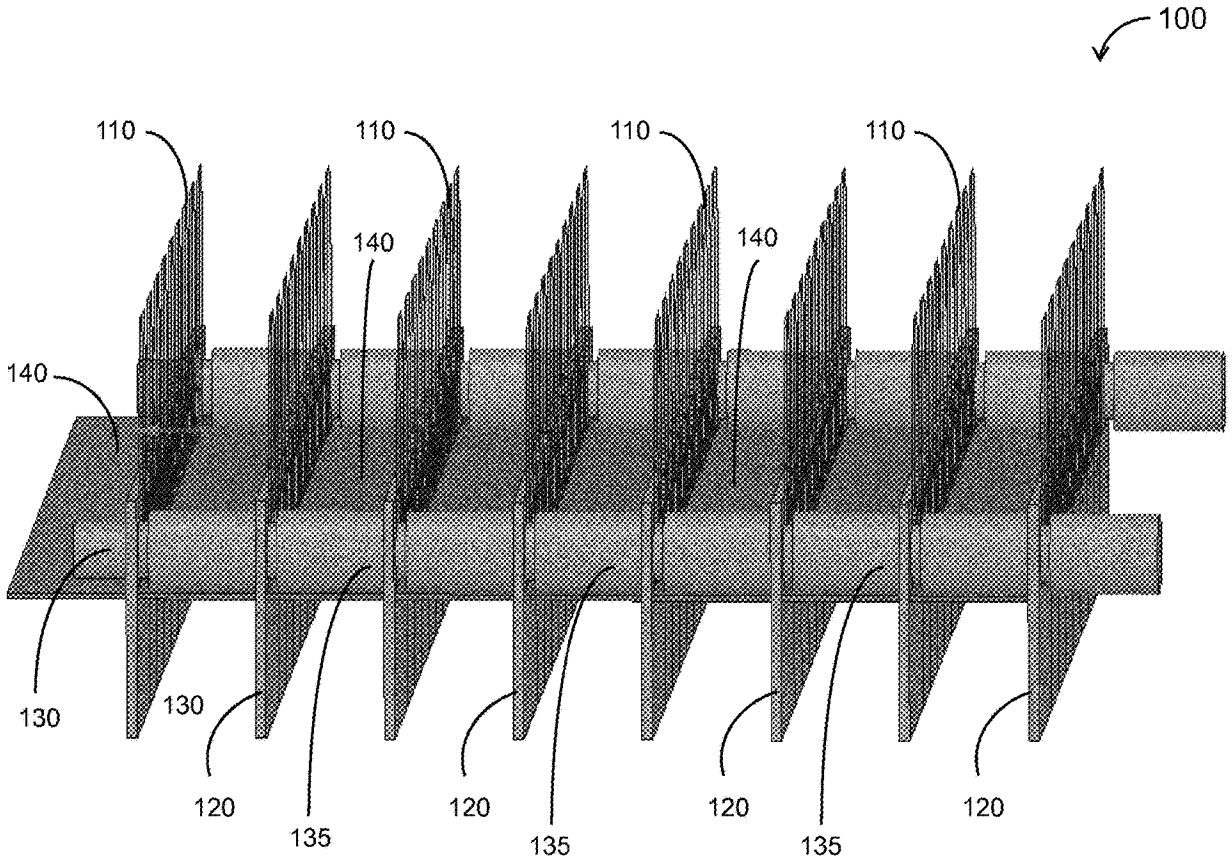
FIG. 1B is a diagram depicting another pictorial view of the first embodiment of a thin metal antenna array system.

With reference to FIGS. 1A and 1B, a thin metal antenna array system 100 can include a plurality of sheet metal structures 110 arranged substantially parallel to one another. The antenna array system 100 can include a plurality of printed circuit boards (PCBs) 120 each of which is mechanically and electrically coupled to a respective sheet metal structure 110, a pair of alignment rods 130, a plurality of spacers 135, and/or a plurality of electromagnetic interference (EMI) gasket planes 140. FIGS. 1A and 1B show two different pictorial views of the thin metal steerable antenna array system 100. The thin metal steerable antenna array system 100 can include other electronic circuitry and/or mechanical components not shown in FIGS. 1A and 1B.

The thin metal antenna array system 100 can include a plurality of sheet metal structures 110. The plurality of sheet metal structures 110 can be arranged parallel, or substantially parallel, to each other. A person skilled in the art would recognize that the plurality of sheet metal structures 110 may not be perfectly parallel to each other but can be parallel to each other within tolerable errors in the orientations of such sheet metal structures 110. For instance, a tolerable error in the orientation of any sheet metal structure 110 can be a deviation by less than 0.01 degree, less than 0.1 degree, less than 0.2 degree or any other value. Each sheet metal structure 110 can include a respective plurality of antenna elements. In particular, each sheet metal structure 110 can be viewed as a single piece of planar metal (or thin metal) representing a row, or a one-dimensional (1-D) array, of antenna elements. As such, the plurality of sheet metal structures 110, when arranged in parallel, can form a two-dimensional (2-D) array of antenna elements.

Figure 2A:
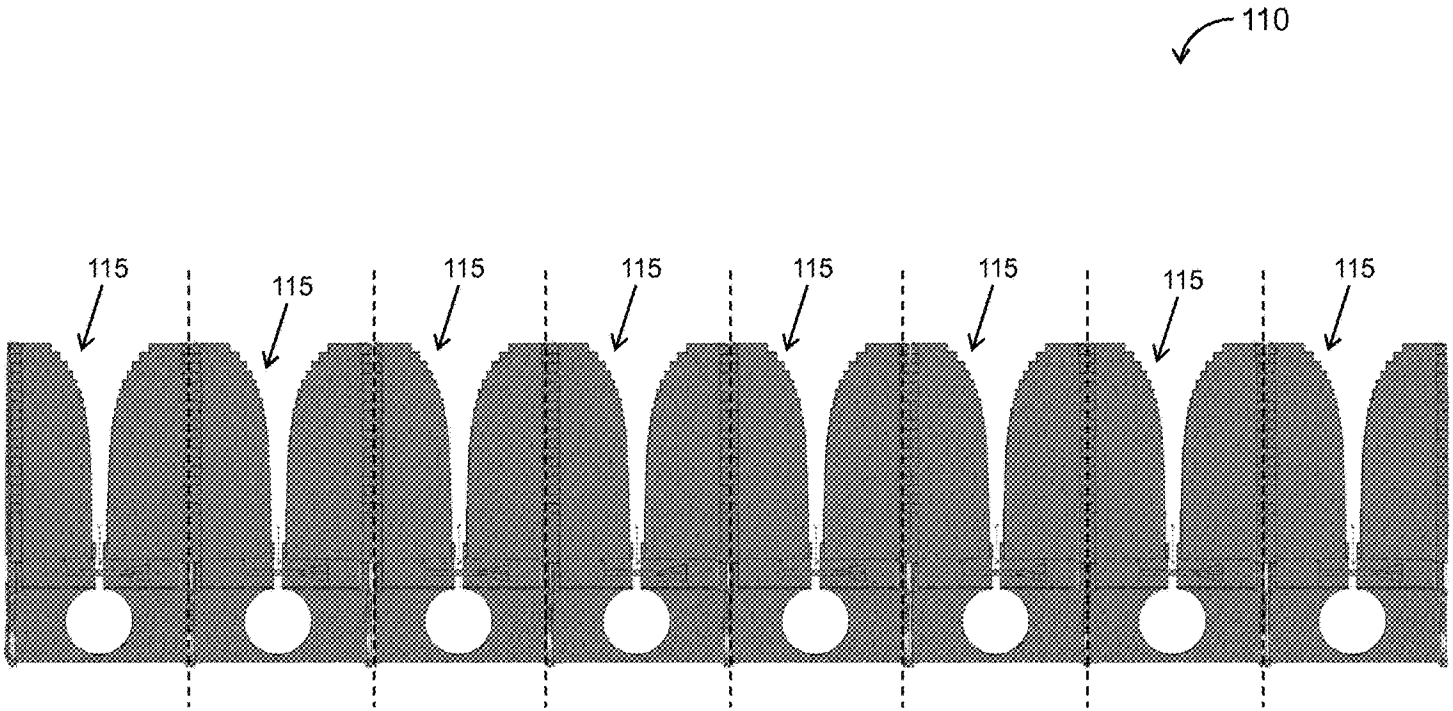
FIG. 2A is a diagram depicting an embodiment of a sheet metal structure.

With reference to FIG. 2A, a sheet metal structure 110 can be a single planar (or thin) metal piece designed/shaped to include a plurality of planar antenna elements 115 and, therefore, form a one-dimensional antenna array. In some implementations, the sheet metal structure 110 can include eight planar antenna elements 115 and form an 8×1 antenna array. While the sheet metal structure 110 shown in FIG. 2 includes 8 planar antenna elements 115, in general, the sheet metal structure 110 can include any number of planar array elements 115. In some implementations, the planar antenna elements 115 can be designed to have a different shape than that shown in FIG. 2A.

The sheet metal structure 110 can be made of a conductive metal or alloy such as stainless steel, copper, brass, or any other conductive metal or alloy. In particular, the sheet metal structures 110 can be manufactured as planar thin metal structures made of such conductive materials. Although sometimes referenced as metal structures in this disclosure, it should be understood that such structures may comprise any metallic and/or conductive material(s) such as alloys. The thickness of the sheet metal structures can be less than 0.1 millimeters (mm), less than 0.5 mm, less than 2 mm, less than one mm, or within another thickness range. In some embodiments, the sheet metal structures 110 can be formed as portions (such as rows, columns, or portions thereof) of high resolution solder paste stencils. In some implementations, one stencil can manufactured or cut to include one or more sheet metal structures 110. The stencils can be manufactured using laser cutting, chemical etching, electroforming or any other manufacturing processes known in the art. The manufacturing processes are selected to allow manufacturing of high resolution (or high definition) sheet metal structures 110 with desired shapes.

Manufacturing tapered antenna slots (TSAs) of antenna arrays as thin conductive metal structures (such as the antenna elements 115 of the sheet metal structures 110) rather than as printed TSAs can allow for increase in maximum operational frequency supported by the antenna arrays and/or reduced manufacturing cost. When designing TSAs for use in steerable array antennas, the width of respective antenna elements (such as antenna elements 115 or antenna elements printed on dielectric material) may be usually upper bounded by the length of the shortest wavelength to be supported by the steerable antenna array. That is, an increase in the highest frequency supported by the steerable antenna array can translate to a decrease in the width of the respective antenna elements. When using printed TSA technology, reducing the size of antenna elements to support relatively high frequency ranges can involve costly manufacturing processes leading to expensive steerable antenna arrays. For example, existing AESA antennas have frequency bands within 2 to 18 GHz. Manufacturing AESA antennas supporting frequencies beyond 18 GHz can be very costly. However, using manufacturing processes such as chemical etching, laser cutting, or electroforming, planar thin metal structures (such as the sheet metal structures 110) with relatively small antenna elements can be manufactured with relatively low cost compared to printed TSA technology. For example, sheet metal structures 110 can be designed to include antenna elements that support a frequency range between 18 GHz and 60 GHz. In other words, the high resolution accuracy of laser cutting, chemical etching, or electroforming allows for manufacturing of sheet metal structures 110 having antenna elements with a respective width small enough to transmit or receive electromagnetic waves with frequencies within 18 GHz to 60 GHz. In some implementations, the sheet metal structures 110 can be designed to support other frequency ranges, and/or frequencies beyond 60 GHz.

Figure 2B:
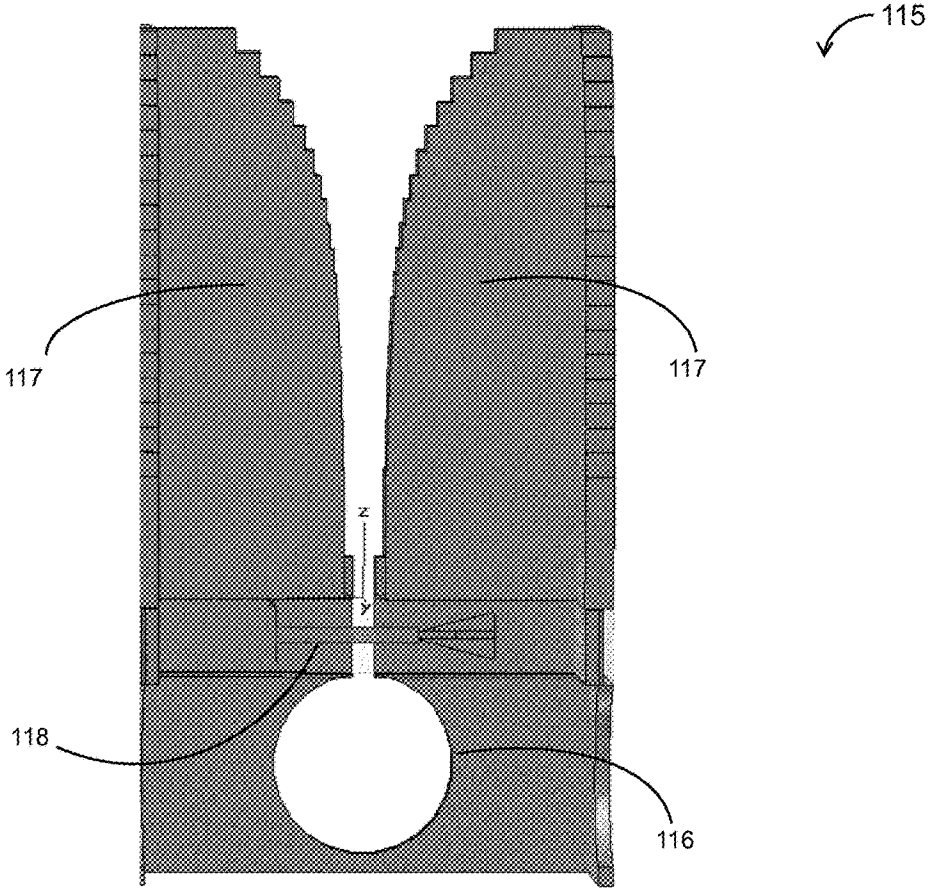
FIG. 2B is a diagram depicting an embodiment of a thin metal antenna element.

With reference to FIGS. 2A and 2B, a sheet metal structure 110 can include a plurality of thin metal planar antenna elements 115. Each antenna element 115 can include to openings (or cavities) 116, two symmetrical lobes 117 separated by a slot with an increasing width, and a microstrip line 118 (also referred to hereinafter as a feed line 118). In some embodiments, the feed line 118 can be arranged on the PCB 120 and in contact with the thin metal (or planar) antenna element 115. That is, the feed line 118 can be arranged on the PCB 120 at a location where the thin metal antenna element 115 attaches to (or intersects with) the sheet metal structure 110. In some other embodiments, the feed line 118 can be arranged on the thin metal antenna element 115 and can be electrically coupled to the PCB 120, associated with the respective sheet metal structure 110, via an electric wire (not shown in FIGS. 2A and 2B). The feed line can be arranged proximate to the cavities 116 and can be configured to excite the cavities 116 using radio frequency (RF) signals. Such excitation can cause electric alternating current (AC) current to propagate mainly along the boundaries of the cavities 116 and the curved (e.g., exponential) edges of both lobes 117. In other words, whether in receiving modes or in transmitting modes, RF signals can propagate between the feed line 118 and the curved edges of the lobes 117 without propagating across to other antenna elements 115 within the same sheet metal structure 110. As such, thin metal antenna elements 115 of a common sheet metal structure 110 can be direct current (DC) connected but not AC connected. In particular, the thin metal antenna elements 115 within any given sheet metal structure 110 can share a common DC ground while RF signals of separate antenna elements 115 do not interfere with each other.

In some implementations, the thin metal antenna elements 115 can have a different shape than that shown in FIGS. 2A and 2B. In particular, the shape of the symmetrical lobes 117 can be designed in a way to improve the radiation patterns of the thin metal antenna elements 115. For example, the symmetrical lobes 117 can include half-circular, arc-shaped, eye-shaped, or other types of groves. In some embodiments, the thin metal antenna element can include a single cavity 116. In general, the thin metal antenna elements 115 can be shaped (e.g., using laser cutting, chemical etching, electroforming, or other manufacturing processes) according to any desired shape.

Referring to FIGS. 1A, 1B, 2A, and 2B, each PCB 120 can be mechanically and electrically coupled to a respective sheet metal structure 110. As illustrated in FIG. 1B, each sheet metal structure 110 can be partially integrated in (or partially blended with) a respective PCB 120. In particular, a portion (e.g., longitudinal lower portion below the circular cavities 116 in FIG. 2A) of the sheet metal structure 110 can be soldered, welded or otherwise attached to the respective PCB 120 such that the antenna elements 115 of the sheet metal structure 110 extend beyond the PCB 120, for example, along (or parallel to) a plane representing a planar surface of the PCB 120. In some other embodiments, each sheet metal structure 110 can be mechanically coupled (e.g., soldered or welded) to a respective PCB 120 such that the planar antenna elements 115 of that sheet metal structure 110 extend beyond the respective PCB 120 along a plane perpendicular to (or at an angle with) a planar surface of the PCB.

Each sheet metal structure 110 can be electrically coupled to a respective PCB 120. In particular, each sheet metal structure 110 can be DC coupled to a ground of the respective PCB 120. For instance, all the thin metal antenna elements 115 of the sheet metal structure 110 can share a common ground with the respective PCB 120. Also, for each thin metal antenna element 115 in the sheet metal structure 110, the feed line 118 of that thin metal antenna element 115 may be electrically coupled to a respective electronic circuit (e.g., a respective circuit of phase shifters and amplifiers/power dividers) in the PCB 120 that is mechanically coupled to the sheet metal structure 110. The electronic circuit associated with each thin metal antenna element 115 can allow for adjusting the phases and/or amplitudes of RF signals received/transmitted by that thin metal antenna element 115. The RF connection between each thin metal antenna element 115 and the respective electronic circuit can be achieved through electric/conductor wires and/or printed wiring on the PCB 120.

Each pair of a sheet metal structure 110 and a respective PCB 120 can be viewed as a steerable antenna ensemble representing a 1-D array (or a row) of steerable antenna elements. Arranging a plurality of steerable antenna ensembles parallel to each other results in a 2-D steerable antenna array (such as a phased array antenna or an AESA antenna) having a linear polarization. In other words, given that all the thin metal array elements 115 of such ensembles are oriented in the same direction, the 2-D steerable antenna supports a polarization parallel to the thin metal antenna elements 115.

The thin metal antenna array system 100 can include a plurality of electromagnetic interference (EMI) gasket planes 140. Each EMI gasket plane 140 can be associated with a respective steerable antenna ensemble (or a respective sheet metal structure 110 and a respective PCB 120). In particular, each EMI gasket plane 140 can be arranged to be oriented perpendicular or at an angle to the respective sheet metal structure 110 and/or the respective PCB 120. For each steerable antenna ensemble, the respective EMI gasket plane 140 can be configured to act as an electromagnetic shield for shielding electromagnetic radiation between the thin metal antenna elements 115 and other circuitry associated with the thin metal antenna array system 100 with. Also, each EMI gasket plane 140 can be configured to act as the DC ground for the respective steerable antenna ensemble. In order to provide a common DC ground for all steerable antenna ensembles, the plurality of EMI gasket planes 140 can be electrically coupled to each other. In some embodiments, the thin metal antenna array system 100 can include a single EMI gasket plane 140 that is configured to act as an electromagnetic shield and a DC ground for all steerable antenna ensembles of the thin metal antenna array system 100. In some embodiments, the thin metal antenna array system 100 can include any number of EMI gasket planes 140.

The thin metal antenna array system 100 can include a pair of alignment rods 130 configured to mechanically couple the steerable antenna ensembles to each other so as to provide mechanical rigidity to the thin metal antenna array system 100 and to allow for spacing between adjacent steerable antenna ensembles (or between adjacent sheet metal structures 110). In some embodiments, the alignment rods 130 can be configured to engage or couple with openings (or cavities) of the PCBs 120 or the sheet metal structures 110. The alignment rods 130 can be configured to engage the PCBs 120 or the sheet metal structures 110 beyond the thin metal antenna elements 115. In other words, the alignment rods 130 can mechanically engage cavities of the PCBs 120 or cavities of the sheet metal structures 110 such that the alignment rods 130 do not mechanically or otherwise interfere with any of the planar structures associated with the antenna elements 115. In some embodiments, the alignment rods 130 can include cavities configured to engage longitudinal extremities of the PCBs 120 or the sheet metal structures. In some embodiments, the alignment rods 130 can be configured to mechanically engage the EMI gasket plane(s) 140. In some other embodiments, the EMI gasket plane(s) 140 can be configured to mechanically engage the steerable antenna ensembles, which in turn can mechanically engage the alignment rods 130.

In some embodiments, the thin metal antenna array system 100 can include any number of alignment rods 130 which for instance do not interfere with the operation and/or characteristics of the thin metal antenna elements 115. The alignment rods 130 can have a cross-sectional area that is circular, square, rectangular, triangular or of any other shape. In some embodiments, the alignment rod(s) 130 can comprise one or more conductive materials (such as conductive metals) and can be configured to electrically couple two or more EMI gasket planes 140 to each other to provide a common ground for the thin metal steerable antenna array system 100. Also, the alignment rod(s) 130 may be mechanically rigid, so as to provide a rigid structure or support to the thin metal steerable antenna array system 100.

Each alignment rod 130 can be configured to engage or couple to a plurality of spacers 135 such that each spacer 135 may be arranged around the alignment rod 130 and/or between two adjacent steerable antenna ensembles (or two adjacent sheet metal structures 110). Accordingly, the spacers 135 can be configured to provide a predefined spatial separation (or distance) between each pair of adjacent sheet metal structures 110. The predefined separation can be defined based on a dimensional parameter (such as length) of the spacers 135. In embodiments where the alignment rod(s) 130 include cavities or other structures to engage the steerable antenna ensembles, separation distances between adjacent sheet metal structures 110 is defined based on the distance between adjacent cavities or structures of the alignment rod (s) 130. The combination of alignment rod(s) 130 and spacers 135 can provide mechanical rigidity and/or stability to the thin metal steerable antenna array system 200 by locking the sheet metal structures 110 in a specific spatial configuration, e.g., at a certain spatial separation and/or orientation with respect to one another.

Figure 3A:
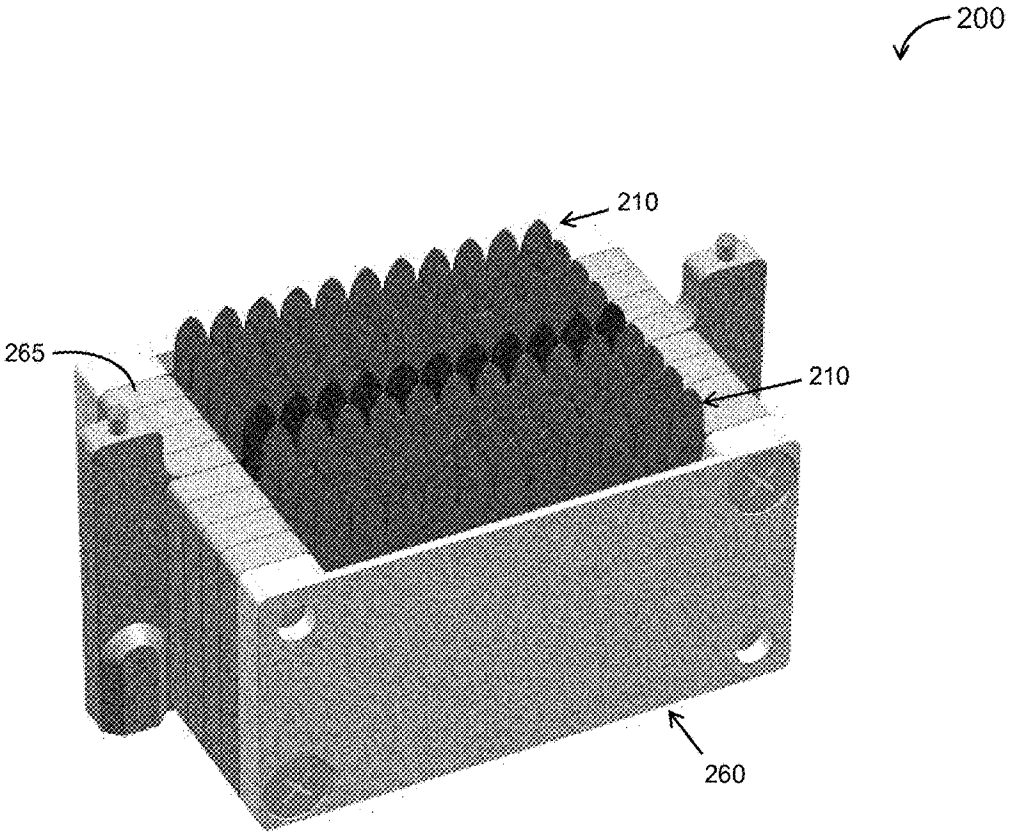
FIGS. 3A and 3B are diagrams depicting two pictorial views of a second embodiment of a thin metal antenna array system.
Figure 3B:
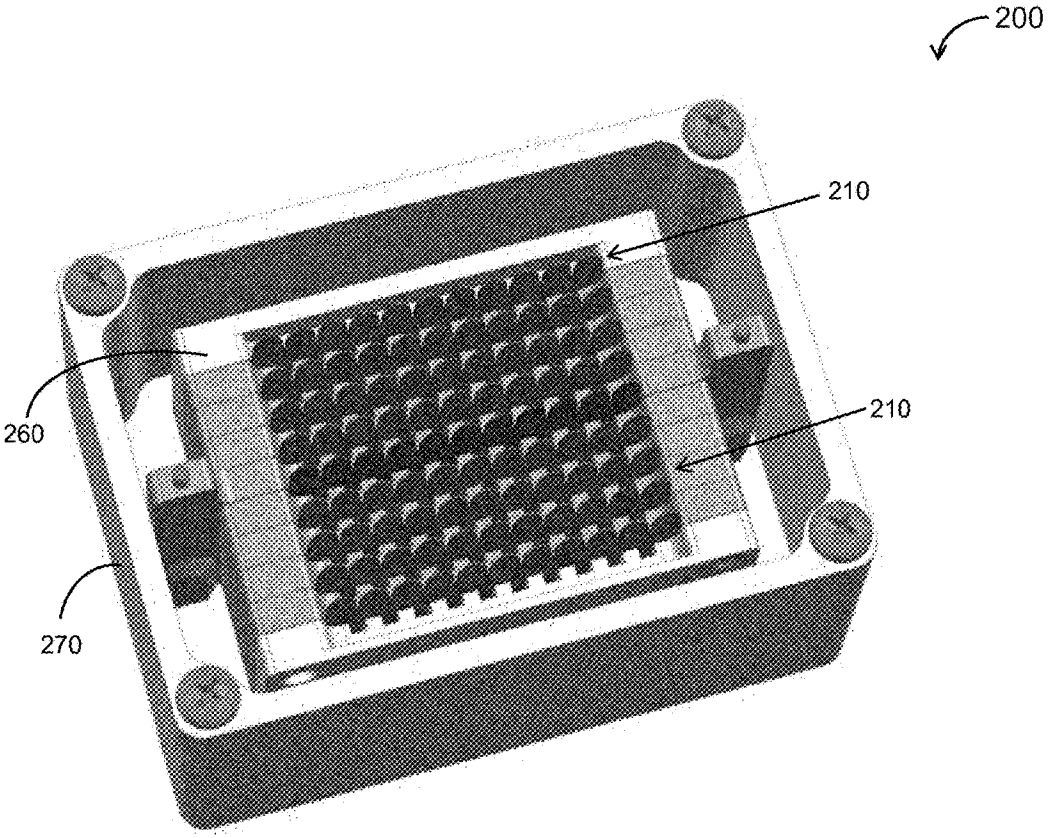

With reference to FIGS. 3A and 3B, a thin metal antenna array system 200 according to a second embodiment can include a plurality of sheet metal structures 210, a plurality of PCBs (not shown in FIGS. 3A and 3B), and an alignment structure 260. The thin metal antenna array system 200 can include a casing (or housing) 270 configured to provide protection to the thin metal antenna array system 200 and/or mechanically couple the thin metal antenna array system 200 to a vehicle or any other operation platform on which the thin metal antenna array system 200 is to be deployed.

The sheet metal structures 210 and the PCBs of the thin metal antenna array system 200 can be similar to the sheet metal structures 110 and the PCBs 120 of the thin metal antenna array system 100 shown in FIGS. 1A and 1B. Each sheet metal structure 210 can be manufactured and then attached to a respective PCB to form a steerable antenna ensemble (or 1-D steerable antenna array) as discussed above with regard to FIGS. 1A and 1B. However, some embodiments of the thin metal antenna array system 200 does not include alignment rods and/or EMI gasket plane(s), for instance as shown in FIG. 3A. Instead, the alignment structure 260 of the thin metal antenna array system 200 can include a plurality of sheet metal housing structures 265, each of which can be configured to receive (or engage) a respective sheet metal structure 210 (or a respective PCB). For example, each sheet metal housing structure 265 can include longitudinal grooves (or mechanical channels) configured to receive side edges of a respective sheet metal structure 210 (or side edges of a respective PCB). Each sheet metal housing structure 265 can be configured to hold and lock a respective sheet metal structure 210 (or a respective PCB) at a fixed position and fixed orientation with respect to that sheet metal housing structure 265.

As illustrated in FIG. 3A, the plurality of sheet metal housing structures 265 can be mechanically coupled to each other (according to a parallel orientation) using one or more alignment pin holes 267 that are configured to receive one or more respective alignment pins (not Shown in FIG. 3A). For each pin hole 267, a respective screw 269 can be used to lock the alignment pin in the pin hole 267 and prevent the sheet metal housing structures 265 from moving along the alignment pin(s). When the sheet metal housing structures 265 are mechanically coupled to each other (e.g., using the alignment pins 269), the respective sheet metal structures 210 can be arranged parallel to one another such that each pair of adjacent sheet metal structures 210 are separated from each other by a predefined distance. The predefined distance can be defined, for example, by the distance between adjacent longitudinal grooves of two adjacent sheet metal housing structures 265. In other words, the plurality of sheet metal housing structures 265, when mechanically coupled to each other, can be configured to lock the sheet metal structures 210 to specific spatial positions and/or orientation(s) (e.g., parallel orientations with predefined separation between each pair of adjacent sheet metal structures 210).

The alignment structure 260 (formed through the mechanical coupling of the plurality of sheet metal housing structures 265) can provide mechanical rigidity and stability to the thin metal antenna array system 200. For example, the alignment structure 260 can prevent bending or geometrical deformation of the thin metal antenna array system 200. In some embodiments, the alignment structure 260 can include one or more alignment pins 268 arranged to engage and hold a radome (or superstrate) on top of (or in front of) the thin metal antenna elements. The radome can protect the sheet metal structures 210 and alter or improve the antenna elements' scan performance. The radome ca act as a wide angle impedance match.

In some embodiments, the alignment structure 260 can be a single mechanical structure (not an ensemble of a plurality of structures) configured to house a plurality of sheet metal structures 210 according to a parallel orientation. For example, the alignment structure 260 can include a plurality of parallel longitudinal grooves (or mechanical channels) arranged within inside walls of the alignment structure 260. In some embodiments, other mechanical coupling mechanisms other than grooves), such as hooks, soldering, or the like, can be used to mechanically couple the sheet metal structures 210 (or the PCBs) to the alignment structures (or the sheet metal housing structures 265).

In some embodiments, the alignment structure 260 (or a portion thereof) can provide electromagnetic shielding to one or more active/electronic components and/or circuitry of the thin metal antenna array system 200. For example, the thin metal antenna array system 200 can include one or more active/electronic circuit components (such as a microprocessor, a digital signal processor, or the like) arranged exterior to alignment structure 260. At least one side of the alignment structure 260 can be configured to provide electromagnetic shielding from electromagnetic radiation associated with the thin metal antenna elements. That is, at least one side of the alignment structure 260 can electromagnetically prevent electromagnetic radiation associated antenna elements of the sheet metal structures from reaching or interfering with electric/electronic circuit components. In some embodiments, the alignment structure 260 (or a portion thereof) can act as a common DC ground for the plurality of sheet metal structures 210, the plurality of PCBs, and/or any other electric/electronic circuit components of the thin metal antenna array system 200.

The thin metal steerable antenna array system 200 can also include a casing (or housing) structure 270. The casing structure 270 can be configured to provide additional protection and/or structural rigidity to the thin metal antenna array system 200. The casing structure 270 can be configured to mechanically couple the thin metal antenna array system 200 to a vehicle or any other deployment platform where the thin metal antenna array system 200 is to be deployed. For example, the casing structure 270 can include screw holes, hooks, grooves, and/or other mechanical structures configured to fasten or attach the second structure 270 to an aircraft or other vehicle. Also, the casing structure 270 can be mechanically coupled to the alignment structure 260 via one or more mechanical structures or mechanisms (such as screws, hooks, grooves, welding, glue, or the like).

Figure 4:
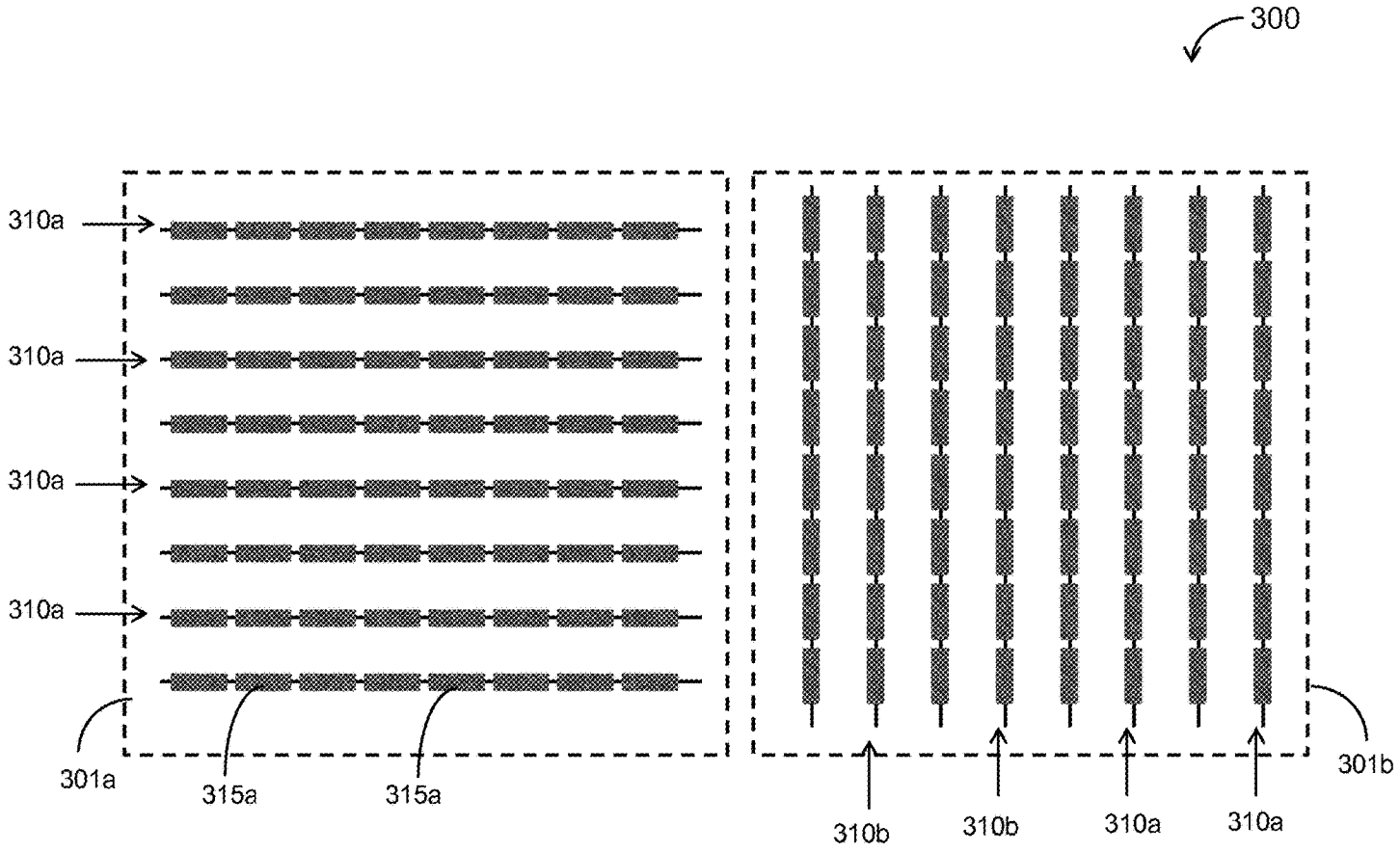
FIG. 4 is a diagram depicting one embodiment of a configuration of sheet metal structures in a thin metal antenna array system that supports dual polarization.

With reference to FIG. 4, a thin metal antenna array 300 can include at least two sets of sheet metal structures 301*a* and 301*b*. A first set of sheet metal structures 301*a* can include a first plurality of sheet metal structures 310*a*, each of which includes a number of planar antenna elements 315*a*. The sheet metal structures 310*a* can be arranged to be parallel to each other. The second set of sheet metal structures 301*b* can include a second plurality of sheet metal structures 310*b*, each of which includes a number of planar antenna elements 315*b*. The sheet metal structures 310*b* can be arranged to be parallel to each other, but perpendicular to the sheet metal structures 310*a*. Accordingly, the combination of the first set 301*a* and second set 301*b* of the sheet metal structures supports dual polarization (or circular polarization). While the configuration of thin metal structures shown in FIG. 4 is illustrated via a simple representation of sheet metal structures, a person skilled in the art would appreciate that each of the sheet metal structures 310*a* and 310*b* can be attached to respective PCB (not shown in the diagram of FIG. 4). Also, the sheet metal structures 310*a* and 310*b* can share a common DC ground.

Figure 5:
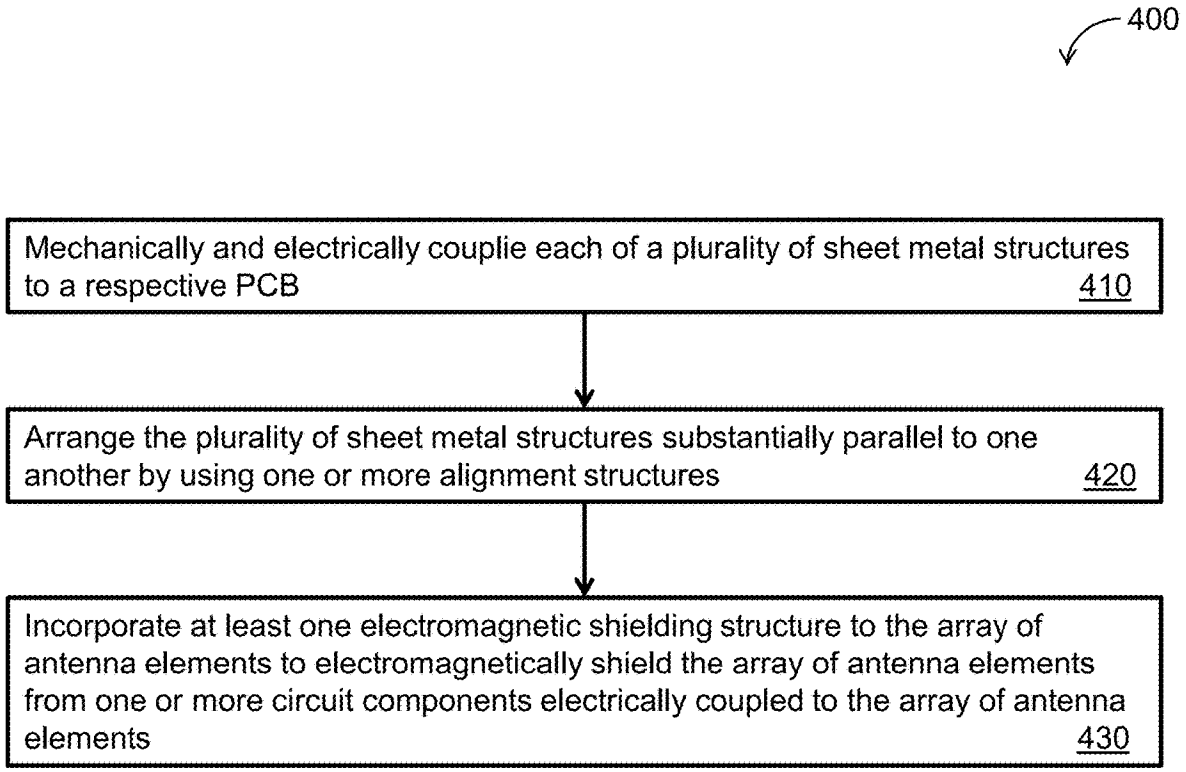
FIG. 5 is a flowchart illustrating one embodiment of a method for manufacturing a thin metal array antenna.

Referring now to FIG. 5, one embodiments of a method 400 of manufacturing an antenna array system is depicted. In brief overview, the method 400 can include mechanically and electrically coupling each of a plurality of sheet metal structures to a respective printed circuit board (PCB) (Block 410), arranging the plurality of sheet metal structures substantially parallel to one another by using one or more alignment structures (Block 420), and incorporating at least one electromagnetic shielding structure to the array of antenna elements to electromagnetically shield the array of antenna elements from one or more circuit components electrically coupled to the array of antenna elements (Block 430).

In some embodiments, the method 400 can include mechanically and electrically coupling each of a plurality of sheet metal structures to a respective printed circuit board (PCB) (Block 410). Given a plurality of sheet metal structures, each including a row of antenna elements (such as sheet metal structures 110), each sheet metal structure can be mechanically coupled to a respective PCB using soldering, welding or other mechanical coupling methods. In some embodiments, a portion of a sheet metal structure (beyond or extending from the antenna elements) can be arranged to at least partially overlap (e.g., via soldering or welding) with or attach to a respective portion of the PCB such that the antenna elements can extend beyond a portion or edge of the PCB. In some embodiments, the sheet metal structure can be mechanically coupled to the PCB using screws or other mechanical coupling mechanisms. In some embodiments, the sheet metal structures can be arranged to be parallel to a planar structure of the PCB. In some embodiments, the sheet metal structures can be arranged to be perpendicular to (or at an angle with) a planar structure of the PCB.

Each of the plurality of sheet metal structures may be electrically coupled to a respective printed PCB. Electrically coupling the sheet metal structure to the PCB can include DC coupling the sheet metal structure to a DC ground of the PCB. Electrically coupling the sheet metal structure to the PCB can include electrically coupling a feed line of each antenna element in the sheet metal structure to a respective circuit of the PCB. For each antenna element, the respective printed circuit can include one or more phase shifters and/or one or more amplifiers (or power dividers).

In some embodiments, the method 400 can include manufacturing the sheet metal structures using laser cutting, chemical etching, electroforming, and/or other metal forming processes. In some embodiments, the sheet metal structures can be formed, cut or manufactured, such that the antenna array system can support a bandwidth including at least the frequency range extending from 18 GHz to 60 GHz. For example, the antenna elements of the sheet metal structures can be formed to have dimensions (e.g., width, feed line length, etc.) appropriate to support transmission and/or reception of signals at frequencies ranging at least between 18 GHz to 60 GHz.

In certain embodiments, the method 400 can include arranging the plurality of sheet metal structures substantially parallel to one another by using one or more alignment structures (Block 420). When arranged in parallel, the plurality of sheet metal structures can form an array of antenna elements. In some embodiments, the one or more alignment structures can include one or more alignment rods (e.g., as illustrated in FIGS. 1A and 1B). In such embodiments, arranging the plurality of sheet metal structures substantially parallel to one another can include inserting or engaging the one or more alignment rods into/through cavities of the sheet metal structures or cavities of the respective PCBs. In some embodiments, the method 400 can include arranging a plurality of spacers over/along/through each alignment rod such that each spacer is arranged between a pair of adjacent sheet metal structures (or pair of adjacent PCBs) to maintain a predefined distance between the pair of adjacent sheet metal structures. In some embodiments, arranging the plurality of sheet metal structures substantially parallel to one another can include soldering or coupling extended portions of the sheet metal structures (or extended portions of the respective PCBs) to the one or more alignments rods, such that adjacent sheet metal structures are arranged at a predefined spatial distance from one another.

In some embodiments, the method 400 can further include mechanically coupling each sheet metal structure (or the respective PCB) to a respective mechanical support structure (such as the mechanical support structure 265 shown in FIG. 3A). Each mechanical support structure can be configured to receive a respective sheet metal structure (or a respective PCB). For example, each mechanical support structure can include one or more channels (or grooves) configured to engage (or receive or hold) a PCB or a sheet metal structure. In such embodiments, arranging the plurality of sheet metal structures substantially parallel to one another can include coupling the mechanical support structures to each other (e.g., via screws and/or other mechanical structures), such that the sheet metal structures are parallel to one another, and each pair of sheet metal structures are spaced from one another by a predefined distance.

In some embodiments, the method 400 can include incorporating at least one electromagnetic shielding structure to the array of antenna elements to electromagnetically shield the array of antenna elements from one or more circuit components electrically coupled to the array of antenna elements (Block 430). In some embodiments, the at least one electromagnetic shielding structure can be part of the one or more alignment structures. For example, as illustrated in FIGS. 3A and 3B, the mechanical support structures 265 when mechanically coupled to each other can form a casing or barrier around the sheet metal structures that can act as an electromagnetic shield.

In some embodiments, the at least one electromagnetic shielding structure can include one or more EMI gasket planes. In such embodiments, the method 400 can further include mechanically coupling the EMI gasket ground plane(s) to the sheet metal structures, the PCBs, and/or the one or more alignment structures. In some embodiments, the at least one electromagnetic shielding structure can include a plurality of EMI gasket planes, and each EMI gasket ground plane may be mechanically coupled to a respective sheet metal structure or PCB. In some embodiments, at least one electromagnetic shielding structure is arranged substantially perpendicular to a planar structure of at least one of the plurality of sheet metal structures.

While FIGS. 1A, 1B, 3A, and 3B depict two embodiments of a thin metal steerable antenna array system 100 or 200, a person skilled in the art would appreciate that other embodiments are encompassed by the current disclosure. For example, other mechanical alignment structures, other than the alignment rods 130 or the first casing 260, can be employed to lock or separate the sheet metal structures at certain distances apart from each other and/or at a given orientation. Also, various metals and manufacturing processes can be employed to construct the sheet metal structures 110 and 210 and/or to mechanically couple such sheet metal structures to respective PCBs 120. Furthermore, the sheet metal structures 110 and 210 and the respective planar antenna elements 115 can be of various shapes and/or various sizes depending, for example, on desired characteristics of the thin metal steerable antenna array system 100 or 200.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

We claim:

1. An antenna array system comprising:

a plurality of planar monolithic sheet metal structures arranged substantially parallel to one another, each planar monolithic sheet metal structure forming a monolithic row of planar antenna elements aligned along a two-dimensional plane common to the planar antenna elements and the planar monolithic sheet metal structure, the plurality of planar monolithic sheet metal structures forming an array of planar antenna elements, the planar antenna elements each having a physical size less than a wavelength corresponding to a center frequency of 60 GHz to support a frequency bandwidth including a frequency range at least extending from 18 GHz to 60 GHz;

a plurality of planar printed circuit boards (PCBs), each planar monolithic sheet metal structure is soldered, welded or attached to a single corresponding PCB of the plurality of planar PCBs, at a longitudinal portion of the planar monolithic sheet metal structure away from the planar antenna elements of the planar monolithic sheet metal structure, such that the single corresponding PCB to which the planar monolithic sheet metal structure is soldered, welded or attached (i) extends beyond the planar monolithic sheet metal structure along, or parallel to, the two-dimensional plane common to the planar antenna elements and the planar monolithic sheet metal structure, and (ii) includes a corresponding electronic circuit integrated within the single corresponding PCB to adjust phases or amplitudes of radio frequency (RF) signals received or transmitted by the planar antenna elements of the planar monolithic sheet metal structure;

at least one electromagnetic shielding structure arranged transverse to the plurality of PCBs, and configured to electromagnetically shield circuitry electrically coupled to the array of planar antenna elements from the array of planar antenna elements and to operate as an electrical ground of the antenna array system; and one or more alignment structures configured to provide mechanical rigidity to the array of planar antenna elements and to allow for spacing between pairs of adjacent planar monolithic sheet metal structures.

2. The antenna array system of claim 1, wherein the planar antenna elements in each planar monolithic sheet metal structure are physically formed using laser cutting or chemical etching.

3. The antenna array system of claim 1, wherein the one or more alignment structures includes the at least one electromagnetic shielding structure.

4. The antenna array system of claim 1, wherein the at least one electromagnetic shielding structure is spatially arranged to be substantially perpendicular to a planar structure of at least one of the plurality of planar monolithic sheet metal structures.

5. The antenna array system of claim 1, wherein the at least one electromagnetic shielding structure includes a plurality of electromagnetic interference (EMI) gasket ground planes, each of the plurality of EMI gasket ground planes physically coupled to a respective one of the plurality of planar monolithic sheet metal structures.

6. The antenna array system of claim 1, wherein the corresponding electronic circuit integrated within the single corresponding PCB includes one or more amplifiers and one or more phase-shifters.

7. The antenna array system of claim 1, wherein the one or more alignment structures comprise one or more alignment rods that are arranged transverse to the plurality of planar monolithic sheet metal structures and the plurality of PCBs, each of the one or more alignment rods mechanically engaging the plurality of planar monolithic sheet metal structures or the plurality of PCBs.

8. The antenna array system of claim 7 further comprising, for each rod of the one or more alignment rods, a respective plurality of spacers arranged the around the alignment rod, such that each spacer of the respective plurality of spacers is arranged along the rod between a corresponding pair of planar monolithic sheet metal structures of the plurality of planar monolithic sheet metal structures or a corresponding pair of PCBs of the plurality of PCBs.

9. The antenna array system of claim 8, wherein each spacer is configured to separate each pair of adjacent planar monolithic sheet metal structures by a predefined distance equal to a length of the spacer.

10. The antenna array system of claim 1, wherein the one or more alignment structures comprise a plurality of mechanical housing structures that are configured to be mechanically coupled to each other, each mechanical housing structure configured to receive a respective planar monolithic sheet metal structure of the planar monolithic plurality of sheet metal structures or a respective PCB of the plurality of PCBs, and wherein the plurality of planar monolithic sheet metal structures are arranged parallel to each other when the plurality of mechanical housing structures are mechanically coupled to each other.

11. A method of manufacturing an array antenna, the method comprising:

electrically coupling, and soldering, welding or attaching each of a plurality of planar monolithic sheet metal structures to a single corresponding printed circuit board (PCB) of a plurality of planar PCBs at a longitudinal portion of the planar monolithic sheet metal structure away from the planar antenna elements of the planar monolithic sheet metal structure, each of the plurality of planar monolithic sheet metal structures forming a monolithic row of planar antenna elements aligned along a two-dimensional plane common to the planar antenna elements and the planar monolithic sheet metal structure, the single corresponding PCB to which the planar monolithic sheet metal structure is soldered, welded or attached, (ii) extending beyond the planar monolithic sheet metal structure along, or parallel to, the two-dimensional plane common to the planar antenna elements and the planar monolithic sheet metal structure, and (ii) including a corresponding electronic circuit integrated within the single corresponding PCB to adjust phases or amplitudes of radio frequency (RF) signals received or transmitted by the planar antenna elements of the planar monolithic sheet metal structure, the planar antenna elements in the planar monolithic sheet metal structure each having a physical size less than a wavelength corresponding to a center frequency of 60 GHz to support a frequency bandwidth including a frequency range at least extending from 18 GHz to 60 GHz;

arranging the plurality of planar monolithic sheet metal structures substantially parallel to one another by using one or more alignment structures, the plurality of planar monolithic sheet metal structures forming an array of planar antenna elements; and incorporating at least one electromagnetic shielding structure transverse to the plurality of PCBs to electromagnetically shield circuitry electrically coupled to the array of planar antenna elements and to operate as an electrical ground of the antenna array system.

12. The method of claim 11 further comprising physically forming the planar antenna elements in each planar monolithic sheet metal structure using laser cutting or chemical etching.

13. The method of claim 11, wherein the one or more alignment structures include the at least one electromagnetic shielding structure.

14. The method of claim 11, wherein incorporating the at least one electromagnetic shielding structure includes spatially arranging the at least one electromagnetic shielding structure to be substantially perpendicular to a planar structure of at least one of the plurality of planar monolithic sheet metal structures.

15. The method of claim 11, wherein the at least one electromagnetic shielding structure includes a plurality of electromagnetic interference (EMI) gasket ground planes, the method further comprising physically coupling each of the plurality of EMI gasket ground planes to a respective one of the plurality of planar monolithic sheet metal structures.

16. The method of claim 11, wherein the corresponding electronic circuit integrated within the single corresponding PCB includes one or more amplifiers and one or more phase-shifters.

17. The method of claim 11, wherein the one or more alignment structures comprise one or more alignment rods that are arranged transverse to the plurality of planar monolithic sheet metal structures and the plurality of PCBs, each of the one or more alignment rods mechanically engaging the plurality of planar monolithic sheet metal structures or the plurality of PCBs.

18. The method of claim 17 further comprising arranging, around each alignment rod of the one or more alignment rods, a respective plurality of spacers, such that each spacer of the respective plurality of spacers is arranged between a corresponding pair of planar monolithic sheet metal structures of the plurality of planar monolithic sheet metal structures or a corresponding pair of PCBs of the plurality of PCBs.

19. The method of claim 18, wherein each spacer is configured to separate each pair of adjacent planar monolithic sheet metal structures by a predefined distance equal to a length of the spacer.

* * * * *